US009541334B2

(12) United States Patent
Von Eckermann et al.

(10) Patent No.: US 9,541,334 B2
(45) Date of Patent: Jan. 10, 2017

(54) HEAT EXCHANGER WITH BYPASS STOPPER, OIL COOLING SYSTEM AND METHOD FOR COOLING OIL

(75) Inventors: Gustaf Von Eckermann, Vikingstad (SE); Brice Joly, Linkoping (FR)

(73) Assignee: TITANX ENGINE COOLING HOLDING AB, Solvesborg (SE)

( * ) Notice: Subject to any disclaimer, the term of this patent is extended or adjusted under 35 U.S.C. 154(b) by 565 days.

(21) Appl. No.: 13/639,690

(22) PCT Filed: Apr. 7, 2011

(86) PCT No.: PCT/SE2011/050418

§ 371 (c)(1),
(2), (4) Date: Oct. 5, 2012

(87) PCT Pub. No.: WO2011/126449

PCT Pub. Date: Oct. 13, 2011

(65) Prior Publication Data

US 2013/0025835 A1 Jan. 31, 2013

(30) Foreign Application Priority Data

Apr. 8, 2010 (SE) ..... 1050342

(51) Int. Cl.
*B60H 1/00* (2006.01)
*F28F 3/00* (2006.01)
(Continued)

(52) U.S. Cl.
CPC ..... *F28D 9/0043* (2013.01); *F28F 9/005* (2013.01); *F28D 2021/0089* (2013.01)

(58) Field of Classification Search
CPC ..... F28D 9/005; F28D 9/0025; F28D 9/0037; F28D 9/0043; B60H 1/18; B60K 11/02; B60K 11/04
(Continued)

(56) References Cited

U.S. PATENT DOCUMENTS 5,099,912 A * 3/1992 Tajima ..... F28D 9/0012 165/133
5,165,468 A * 11/1992 Tajima ..... B60K 11/04 165/167
(Continued)

FOREIGN PATENT DOCUMENTS

CN 2281513 5/1998
CN 201392119 1/2010
(Continued)

OTHER PUBLICATIONS

Extended European Search Report for EP 11766248.6, Completed by the European Patent Office, Dated Dec. 15, 2014, 7 Pages.
(Continued)

*Primary Examiner* — Len Tran
*Assistant Examiner* — Claire Rojohn, III
(74) *Attorney, Agent, or Firm* — Brooks Kushman P.C.

(57) ABSTRACT

A heat exchanger for an oil cooler including at least two heat exchanger members, each of which enclosing a first channel. A second channel is formed between the two heat exchanger members. An edge portion of a first one of the heat exchanger members, presents a bypass restrictor extending towards an edge portion of a second one of the heat exchanger members, and the bypass restrictor forms an outer wall of the heat exchanger. A system having such an oil cooler and a method for cooling oil are also disclosed.

14 Claims, 7 Drawing Sheets

(51) Int. Cl.

| | |
|---|---|
| ***F28F 3/08*** | (2006.01) |
| ***F28D 9/00*** | (2006.01) |
| ***F28F 9/00*** | (2006.01) |
| *F28D 21/00* | (2006.01) |

(58) Field of Classification Search
USPC ..... 165/41, 153, 165, 166, 167, 916
See application file for complete search history.

(56) References Cited

U.S. PATENT DOCUMENTS

| | | | | |
|---|---|---|---|---|
| 5,184,673 | A | 2/1993 | Hedman et al. | |
| 5,931,219 | A * | 8/1999 | Kull | F28D 9/005 165/166 |
| 5,956,165 | A | 9/1999 | Fee et al. | |
| 6,516,874 | B2 | 2/2003 | Mathur et al. | |
| 7,416,018 | B2 | 8/2008 | Thunwall et al. | |
| 2002/0129926 | A1 * | 9/2002 | Yamaguchi | F28D 9/0012 165/41 |
| 2005/0173101 | A1 | 8/2005 | Ohno | |
| 2006/0011333 | A1 | 1/2006 | Emrich et al. | |
| 2006/0032621 | A1 * | 2/2006 | Martin | F28F 9/026 165/167 |
| 2006/0219394 | A1 | 10/2006 | Martin et al. | |
| 2007/0000639 | A1 * | 1/2007 | Ozawa | F28D 9/0043 165/41 |
| 2008/0087411 | A1 | 4/2008 | Richter | |
| 2008/0202735 | A1 | 8/2008 | Geskes et al. | |
| 2009/0126911 | A1 | 5/2009 | Shore et al. | |
| 2010/0314084 | A1 * | 12/2010 | Takeuchi | F25B 37/00 165/166 |

FOREIGN PATENT DOCUMENTS

| | | | | |
|---|---|---|---|---|
| DE | 3826244 | | 2/1990 | |
| DE | 3826244 | A1 * | 2/1990 | F28F 9/22 |
| DE | 4020754 | | 1/1992 | |
| DE | 102006033313 | | 3/2007 | |
| GB | 2111187 | | 6/1983 | |
| GB | 2130354 | | 5/1984 | |
| JP | H02147672 | | 12/1990 | |
| JP | 10441972 | | 4/1992 | |
| JP | H0722622 | | 5/1995 | |
| JP | H1073393 | | 3/1998 | |
| JP | H11142089 | | 5/1999 | |
| JP | 11287115 | | 10/1999 | |
| JP | H11287115 | | 10/1999 | |
| JP | 2000204941 | | 7/2000 | |
| JP | 2001263967 | | 9/2001 | |
| JP | 2002195783 | | 7/2002 | |
| JP | 2002195785 | | 7/2002 | |
| JP | 2002267384 | | 9/2002 | |
| JP | 2003097890 | | 4/2003 | |
| JP | 2005315514 | | 11/2005 | |
| JP | 2005337528 | | 12/2005 | |
| JP | 2007232355 | | 9/2007 | |
| JP | 2007303812 | | 11/2007 | |
| JP | 2008527304 | | 7/2008 | |
| JP | 2009133598 | | 6/2009 | |
| SE | WO 8605866 | A1 * | 10/1986 | F28D 9/005 |
| WO | 9013394 | | 11/1990 | |
| WO | 9913394 | | 3/1999 | |
| WO | 2004027334 | | 4/2004 | |
| WO | 2006074903 | | 7/2006 | |

OTHER PUBLICATIONS

International Search Report for PCT/SE2011/050418, Completed by the Swedish Patent Office on Jun. 21, 2011, 3 Pages.

* cited by examiner

HEAT EXCHANGER WITH BYPASS STOPPER, OIL COOLING SYSTEM AND METHOD FOR COOLING OIL

CROSS-REFERENCE TO RELATED APPLICATION

This application is the U.S. national phase of PCT Appln. No. PCT/SE2011/050418 filed on Apr. 7, 2011, which claims priority to Swedish Patent Application No. 1050342-3 filed on Apr. 8, 2010, the disclosures of which are incorporated in their entirety by reference herein.

TECHNICAL FIELD

The present disclosure relates to heat exchangers, and more particularly to heat exchangers which are suitable for use as oil coolers in heavy vehicles.

The disclosure relates particularly to heat exchangers which are of a so-called single-flow integrated type, i.e. heat exchangers which provide for an integrated flow of one medium (heat emitting medium), whereas the heat exchanger is substantially immersed in another medium (e.g. cooling medium).

BACKGROUND

A heat exchanger for use as an oil cooler in e.g. heavy vehicles may be formed from a plurality of parallel plates, which are stacked, such that parallel channels are formed between the plates. Typically, every second one is arranged to carry a flow of cooling medium, and the other channels are arranged to carry a flow of heat-emitting medium. The plates may be brazed together to form a single heat-exchanger unit.

The basic principle for forming such a heat exchanger is disclosed in e.g. WO90/13394A1 and WO2004027334A1.

When in use, the heat exchanger is typically arranged in a cavity, through which the cooling medium is caused to flow, while heat-emitting medium is fed through an inlet opening of the heat exchanger, through the channels for the heat-emitting medium, after which the cooled heat-emitting medium is extracted through an outlet opening of the heat exchanger. Hence, the channels for the cooling medium are open to the cavity.

Due to vibrations and manufacturing tolerances, there is always a space between the walls confining the cavity and the heat exchanger. This space will cause some of the cooling medium to bypass the heat exchanger, thus negatively affecting its efficiency.

GB2130354A discloses how a sealing strip comprising a rubber-elastic material may be used to prevent the cooling medium from bypassing the heat exchanger.

Similarly, DE 4020754A1 discloses how a plurality of sealing lips may be arranged to prevent the cooling medium from bypassing the heat exchanger.

U.S. Pat. No. 6,516,874 B2 discloses how a plurality of shims and baffle clips may be arranged to close the longitudinal sides of the heat exchanger, thus effectively preventing the cooling medium from bypassing the heat exchanger.

There is a need for an improved heat exchanger, which is suitable for use as an oil cooler in e.g. heavy vehicles.

SUMMARY

It is an object of the present disclosure to provide a heat exchanger, which is suitable for use as an oil cooler in a heavy vehicle. It is a particular object to provide a more efficient heat exchanger. Yet another object is to provide a heat exchanger which is robust and easy to install.

The invention is defined by the appended independent claims. Embodiments are set forth in the dependent claims, in the following description and in the drawings.

According to a first aspect, there is provided a heat exchanger for an oil cooler, comprising: at least two heat exchanger members, enclosing a first channel; wherein a second channel is formed between the two heat exchanger members. An edge portion of a first one of the heat exchanger members presents a bypass restrictor extending towards an edge portion of a second one of the heat exchanger members, and the bypass restrictor forms an outer wall of the heat exchanger.

The bypass restrictor will at least partially close the second channel, thus preventing or reducing bypass flows to or from said second channel. The bypass restrictor may also form an outer, or outwardly facing, wall of the heat exchanger.

The bypass restrictors will steer or eliminate flow at the perimeter of the heat exchanger members. By preventing or reducing bypass flows, the heat rejection of the heat exchanger is improved.

The bypass restrictor may extend continuously along said at least a part of said edge portion of said first one of the heat exchanger members.

By "extending continuously" is meant that the bypass restrictor presents a substantially constant cross section over a portion of its extension.

The bypass restrictor may extend substantially in parallel with a main flow direction in the second channel.

In particular, the bypass restrictor may extend along at least ¼, ⅓, ½, ⅔ or ¾ of a length of the second channel.

The bypass restrictor may, along its extension, provide a substantially continuous seal against the second one of the heat exchanger members. By "substantially continuous" it is understood that the seal may be continuous but for some minor leaks, which may be caused by tolerances or brazing defects.

The edge portion may be an edge portion which extends substantially in parallel with a main flow direction in the second channel, such as e.g. a longitudinal edge portion.

The heat exchanger plates may be joined together along the entire periphery thereof, thereby effectively closing the first channel.

The bypass restrictor may be in contact with the edge portion of the second one of the heat exchanger members.

The bypass restrictor may thus completely prevent bypass flow.

The bypass restrictor may be joined with the edge portion of the second one of the heat exchanger members.

Such joining may be achieved by welding or brazing, thus effectively also forming the connection between the heat exchanger members. The need for a separate bolt to hold the units together is thus eliminated.

The bypass restrictor may be provided by the edge portion of the heat exchanger member being folded to form a flange.

For example, the flange may be formed by folding one or both of the heat exchanger plates forming the heat exchanger member.

As an alternative, the bypass restrictor may be formed by a ridge in the immediate vicinity of the edge of one or both of the heat exchanger plates forming the heat exchanger member.

The ridge may be formed on the edge of the plate, or it may be slightly spaced from the edge. Typically, the ridge extends in parallel with the edge of the heat exchanger member. The spacing from the edge may be in the order of 1-5 mm, preferably 1-2 mm.

At least one of the heat exchanger members may be formed by a pair of joined together heat exchanger plates.

As one alternative, at least one of the heat exchanger members may be formed by a substantially tubular body.

At least one of an inlet and an outlet of the second channel is open to a cavity in which the heat exchanger is to be placed.

Hence, the coolant is introduced into the cavity, and then caused to flow through the heat exchanger package. According to a second aspect, there is provided an oil cooling system, comprising a cavity having a liquid cooling medium inlet and a liquid cooling medium outlet; an oil inlet for oil to be cooled and an oil outlet for cooled oil; a heat exchanger, as described above, said heat exchanger being substantially enclosed in said cavity.

The outer wall of the heat exchanger may be spaced from a corresponding wall of the cavity.

A flow restrictor may be arranged to prevent the cooling medium from flowing outside the outer wall of the heat exchanger.

According to a third aspect, there is provided a method for cooling oil in a vehicle using an oil cooling system as described above, the method comprising causing the oil to be cooled to flow from the oil inlet through the first channel to the oil outlet, and causing liquid cooling medium to flow from the cooling medium inlet through the second channel to the cooling medium outlet.

In the method, some of the liquid cooling medium may be caused to flow outside the outer wall of the heat exchanger.

In the method, some of the liquid cooling medium may be caused to flow between the bypass restrictor and the edge portion of the second one of the heat exchanger members.

In the method, some of the liquid cooling medium may be at least partially, preferably entirely, prevented from flowing between the bypass restrictor and the edge portion of the second one of the heat exchanger members.

As an alternative, the liquid cooling medium may be prevented from flowing outside the outer wall of the heat exchanger.

DESCRIPTION OF EMBODIMENTS

Figure 1:
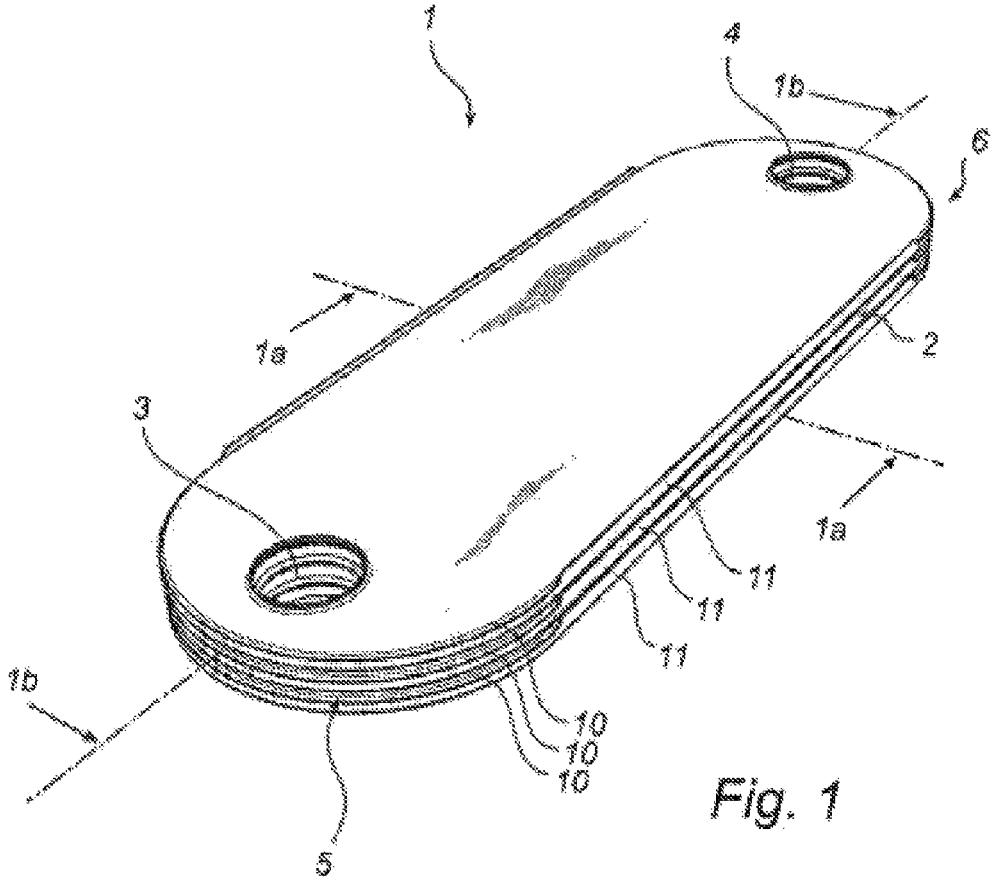
FIG. 1 is a schematic perspective view of a heat exchanger stack according to a first embodiment of the present disclosure.

FIG. 1 illustrates a stacked plate heat exchanger 1 formed by three joined heat exchanger members 10. The elongate heat exchanger has spaced apart first and second ports 3, 4, communicating with elongate first channels 12 which typically are used for the medium to be cooled and first and second openings 5, 6, communicating with elongate second channels 7 which typically are used for the cooling medium. It is understood that the ports 3, 4 may be used for the cooling medium and the openings 5, 6 may be used for the medium to be cooled.

The heat exchanger 1 presents an outer wall 2, which is formed by flanges 11 of the heat exchanger members 10. The flanges form bypass restrictors for second channels 7 which are defined between a planar portion 19 of the exterior surface of one of the heat exchanger members 10 and facing planar portion 19 of the exterior surface of an adjacent heat exchanger member 10.

In the embodiment illustrated in FIG. 1, the flange does not contact the adjacent heat exchanger member. Hence, a bypass flow $F_{CB}$ will be reduced, but not entirely prevented. In the event that it is desirable to entirely prevent bypass flow $F_{CB}$, then the flanges can be designed to contact the adjacent heat exchanger member (FIGS. 1*d*, 1*e*), possibly along the entire length of the flange 11. It is also possible to join the heat exchanger members to each other by fastening the flange to the adjacent heat exchanger member, e.g. by brazing, soldering or welding. As an alternative, glue may be used to achieve the fastening. A sealant may be used to provide sealing between the flange and the adjacent heat exchanger member.

Figure 1A:
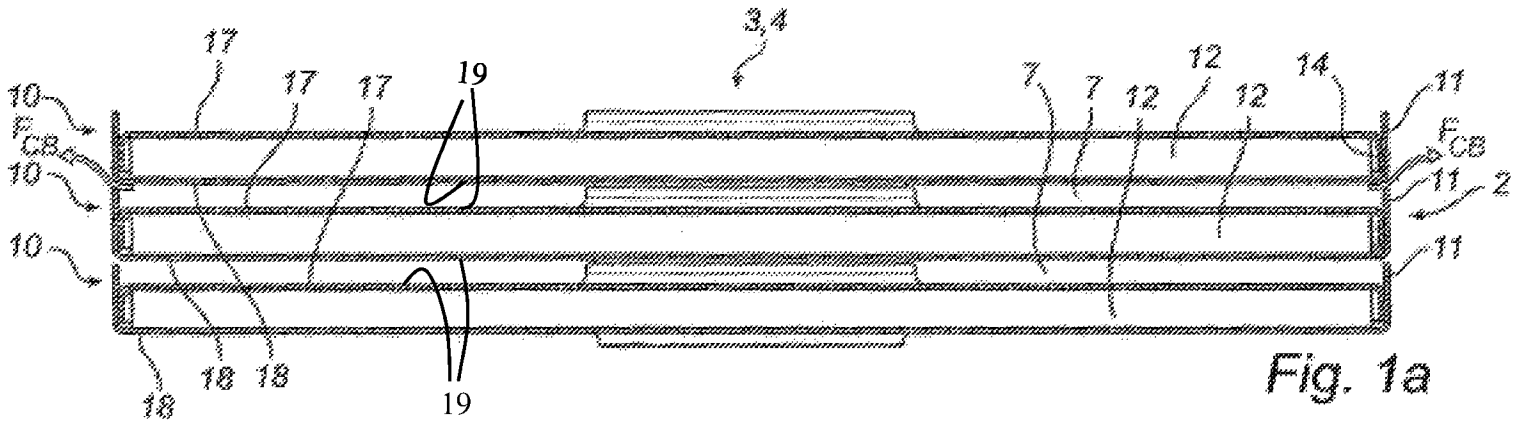
FIGS. 1*a* and 1*b* are schematic sectional views of the heat exchanger stack of FIG. 1 taken along lines 1*a*-1*a* and 1*b*-1*b*, respectively.
Figure 1B:
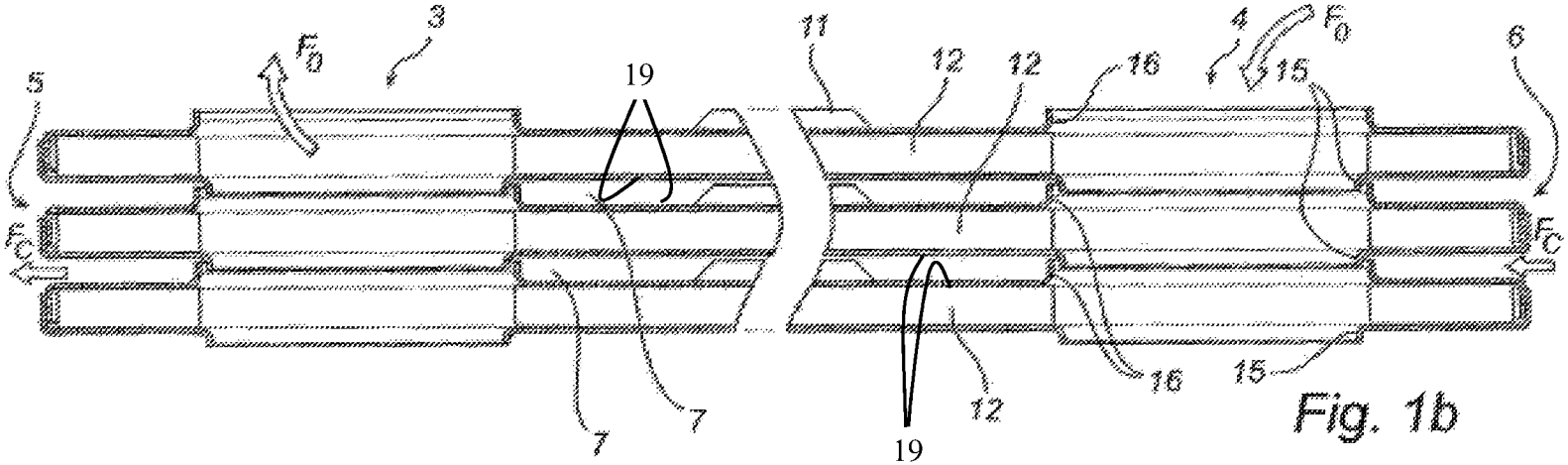

Referring to FIGS. 1*a* and 1*b*, the ports 3, 4 are connected to a first channel 12, which is formed inside each heat exchanger member 10. Each heat exchanger member 10 is formed by a pair of heat exchanger plates 17, 18, which are joined together at their peripheries and at the ports 3, 4.

An edge portion of each heat exchanger member is folded to provide the flange 11. In the embodiment illustrated in FIGS. 1*a* and 1*b*, the flange is formed by a fold provided on one of the plates 18, while the edge portion of the other plate 17 is folded in the opposite direction, towards the plate 18.

Figure 1C:
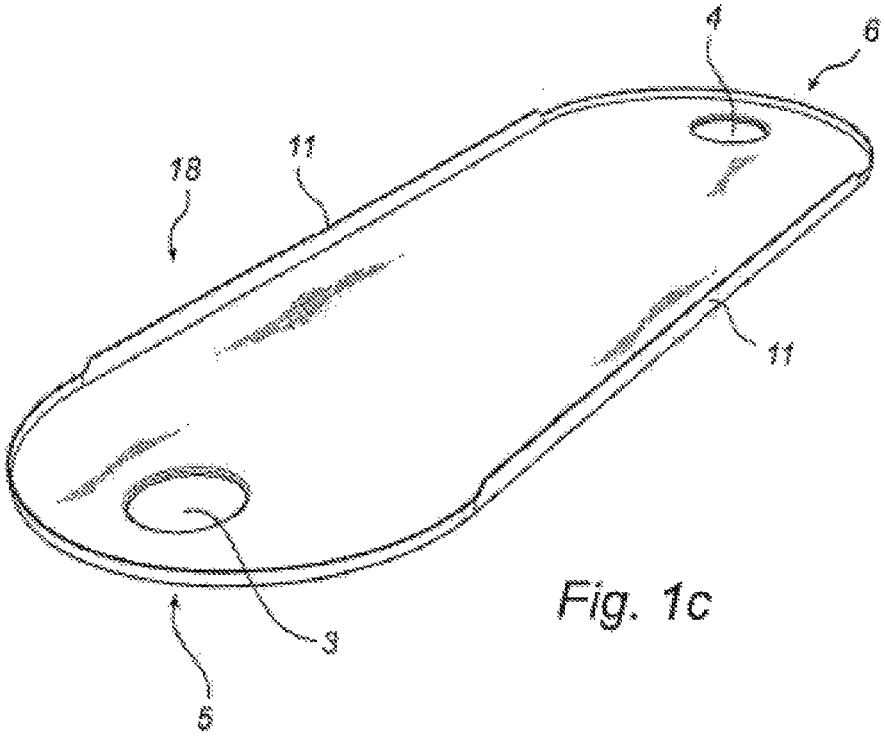
FIG. 1*c* is a schematic perspective view of a heat exchanger plate forming part of the heat exchanger stack of FIG. 1.

FIG. 1*c* schematically illustrates a heat exchanger plate 18 designed for a coolant flow which is substantially parallel with the long edges of the heat exchanger plate, and which thus is entirely open at its short edges.

Figure 1D:
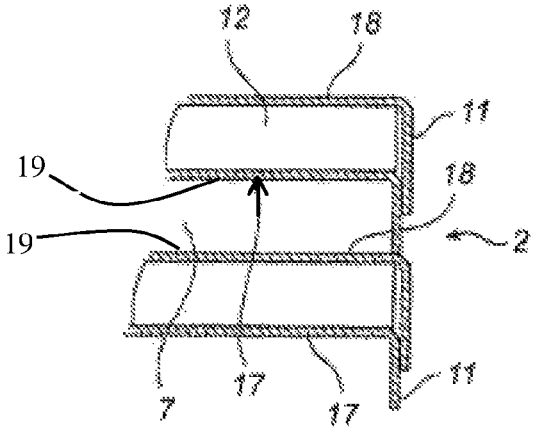
FIG. 1*d* is a schematic sectional view of another embodiment of the bypass restrictor.

Referring to FIG. 1*d*, the bypass restrictor, here in the form of a flange 11, may extend all the way to the adjacent heat exchanger member, thus entirely preventing bypass flow.

As illustrated in FIG. 1*d*, both plates 17, 18 may be folded towards the same direction, such that both form part of the flange 11.

Figure 1E:
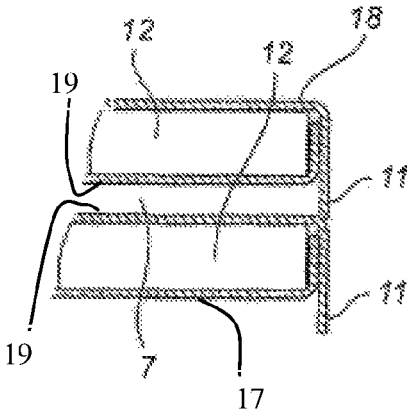
FIG. 1*e* is a schematic sectional view of yet another embodiment of the bypass restrictor.

As mentioned above, as an alternative, and as illustrated in FIG. 1*e*, the edges of the plates may be folded in different directions, with one of them extending beyond the other one and all the way to the adjacent heat exchanger member, thus entirely preventing bypass flow.

Figure 2:
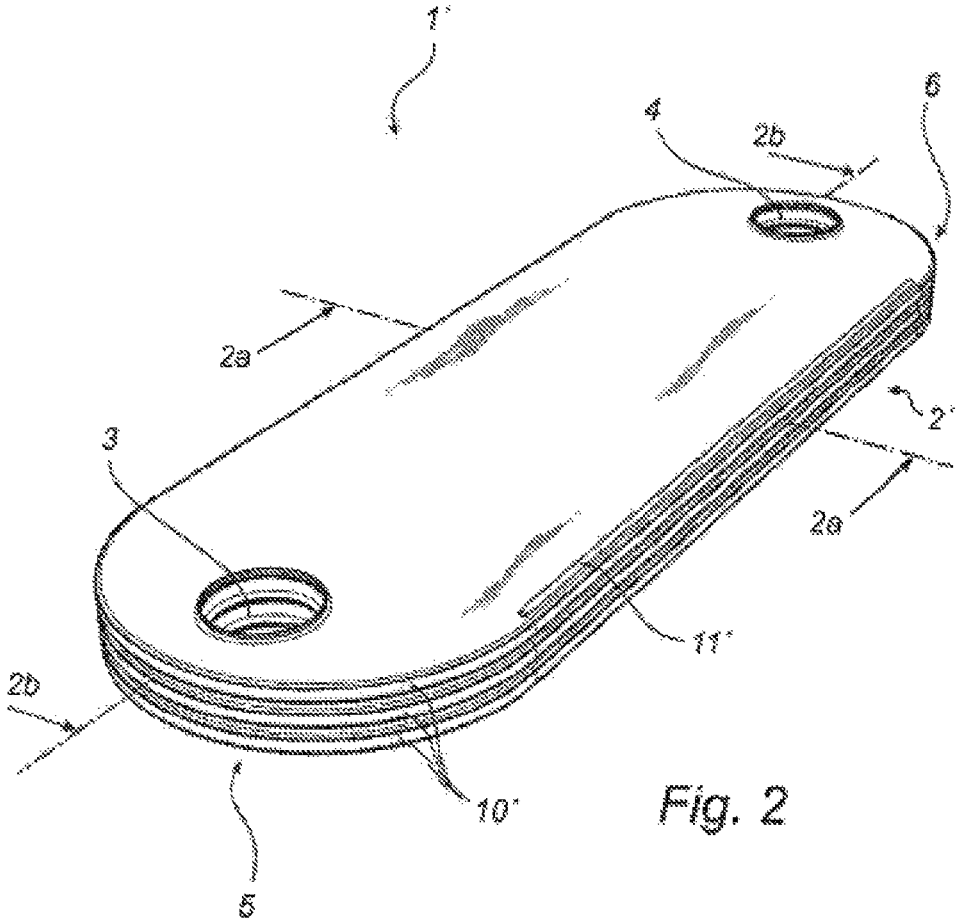
FIG. 2 is a schematic perspective view of a heat exchanger stack according to a second embodiment of the present disclosure.

FIG. 2 schematically illustrates an embodiment of a heat exchanger 1', formed by a number of heat exchanger members 10', wherein the bypass restrictor 11' is formed as a ridge extending along the peripheral edge of a portion of the heat exchanger member 10'.

Figure 2A:
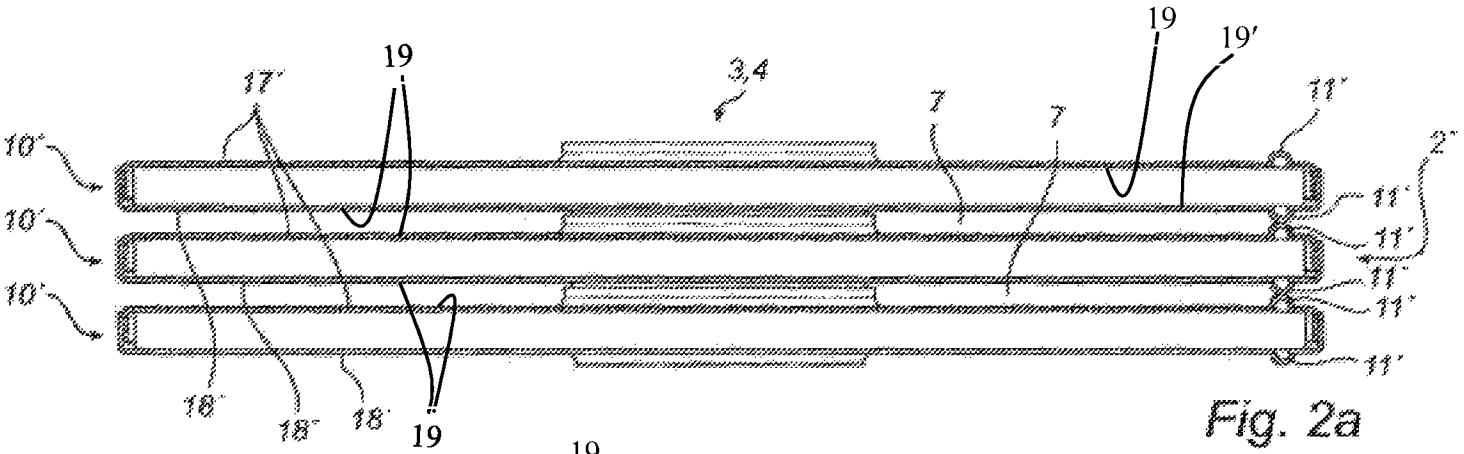
FIGS. 2*a* and 2*b* are schematic sectional views of the heat exchanger stack of FIG. 2 taken along lines 2*a*-2*a* and 2*b*-2*b*, respectively.
Figure 2B:
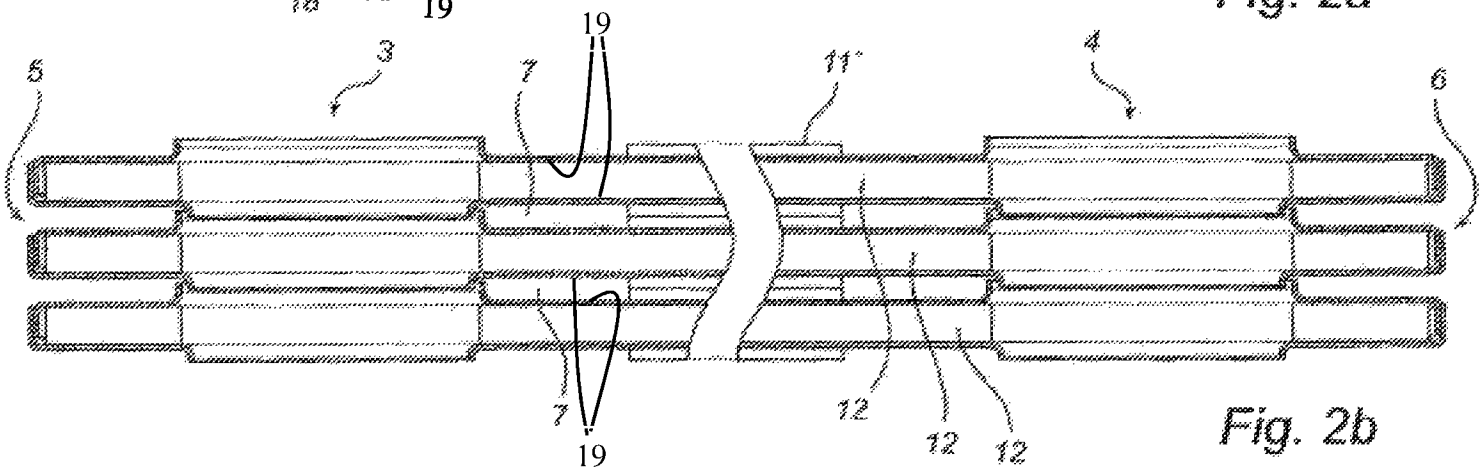

FIGS. 2*a* and 2*b* schematically illustrates the configuration of each heat exchanger member 10' of this embodiment. As can be seen at the right portion of FIG. 2*a*, each plate 17', 18' is formed with a ridge along its edge forming the bypass restrictor 11'. When the units 10' are joined together, the bypass restrictors 11' form an outer wall 2' of the heat exchanger. This outer wall may, provided that the ridges of adjacent heat exchanger members 10' contact each other, effectively prevent bypass flow $F_{CB}$. Although not illustrated, bypass restrictors 11' may be arranged along both long edges, and, if desired, also along a portion of the short edges.

It is also possible to join the heat exchanger members 10' to each other by fastening the ridge 11' to the ridge 11' of the adjacent heat exchanger member 10', e.g. by brazing, soldering or welding. Glue may also be used to achieve such fastening. It is possible to provide a sealant to seal the space between the ridges.

Figure 3:
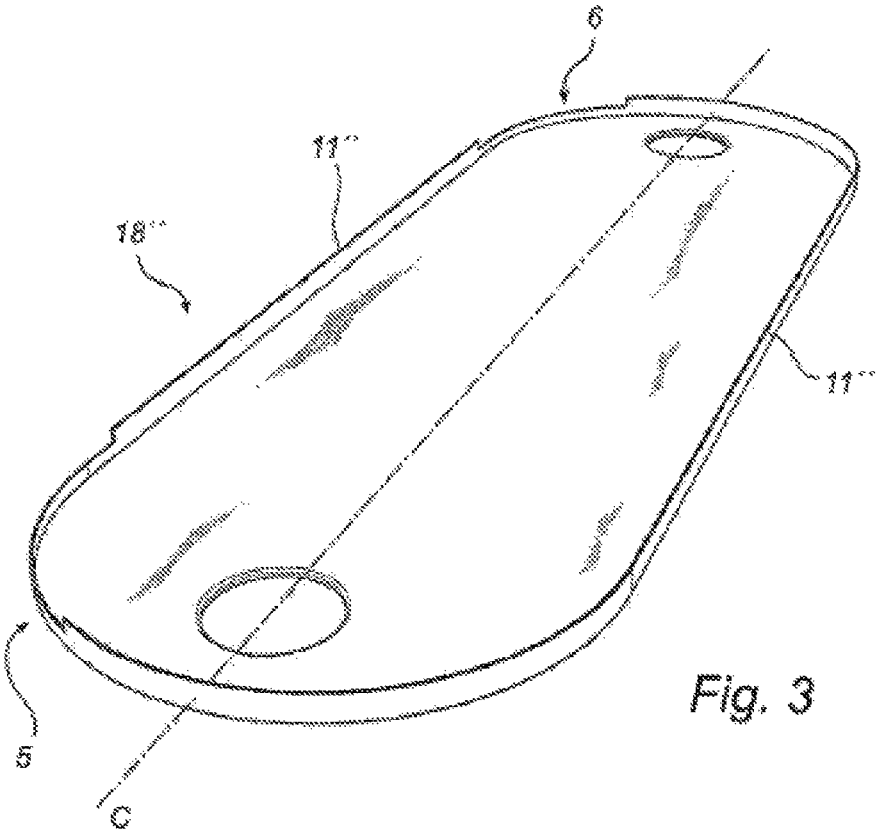
FIG. 3 is a schematic perspective view of a heat exchanger plate according to another embodiment of the present disclosure.

Referring to FIG. 3, there is illustrated an embodiment wherein the openings 5, 6 are smaller than the width of the heat exchanger, and where both the openings 5, 6 are arranged on the same side of a longitudinal centre line C of the heat exchanger plate 18". Most of the short edges are covered by a flange 11".

Figure 4:
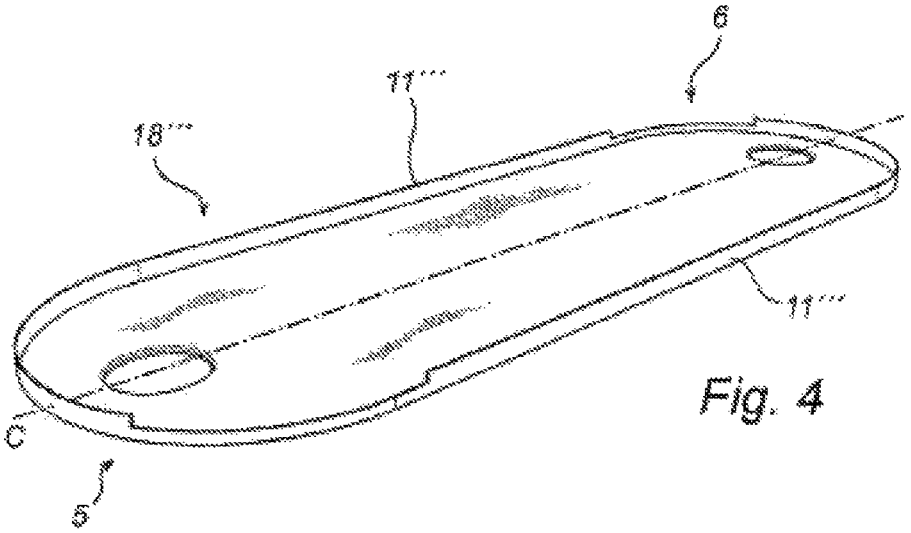
FIG. 4 is a schematic perspective view of a heat exchanger plate according to yet another embodiment of the present disclosure.

Referring to FIG. 4, there is illustrated an embodiment wherein the openings 5, 6 are smaller than the width of the heat exchanger, and where the openings 5, 6 are arranged on different sides of the longitudinal centre line C of the heat exchanger plate 18'". Most of the short edges are covered by a flange 11'".

The plates 17, 18; 17', 18'; 17", 18" forming the heat exchanger member may be joined by brazing or welding, as is conventional.

Furthermore, the heat exchanger members 10, 10', 10" may be joined together by brazing or welding about the ports 3, 4 and optionally also peripherally by the flange 11, 11', 11" of one heat exchanger member being brazed or welded to the periphery of an adjacent heat exchanger member.

Figure 5:
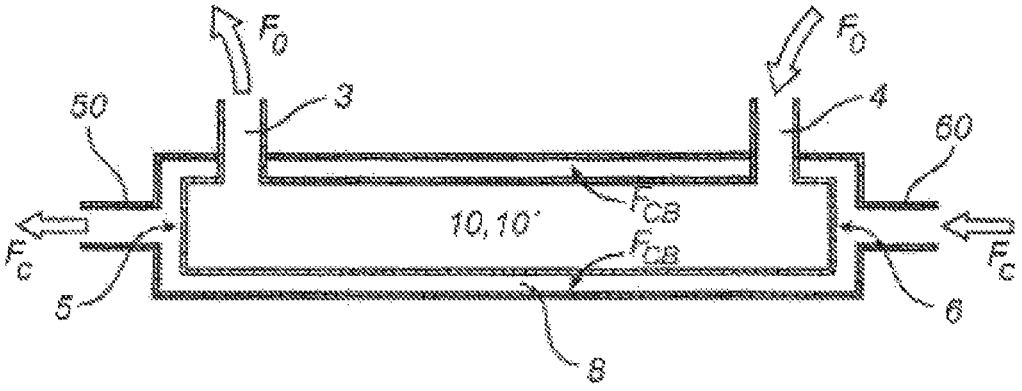
FIG. 5 is a schematic sectional view of an oil cooling system wherein a heat exchanger stack according to any of the embodiments disclosed herein may be used.

Referring to FIG. 5, there is disclosed a heat exchanger system comprising a heat exchanger 10, 10', which is arranged in a cavity 8. Cooling medium inlet 60 and cooling medium outlet 50 are connected to the cavity, such that the cooling medium is allowed to enter the opening 5 of the heat exchanger 10, 10' and exit at the opening 6 of the heat exchanger 10, 10', thus flowing via channel 7 in the direction indicated by Arrow Fc.

The oil to be cooled may enter port 4 and exit at port 3 via channel 12, thus flowing in the direction indicated by Fo. It is noted that the flows Fo and Fc may be arranged in the same direction or as counter flows.

Figure 6:
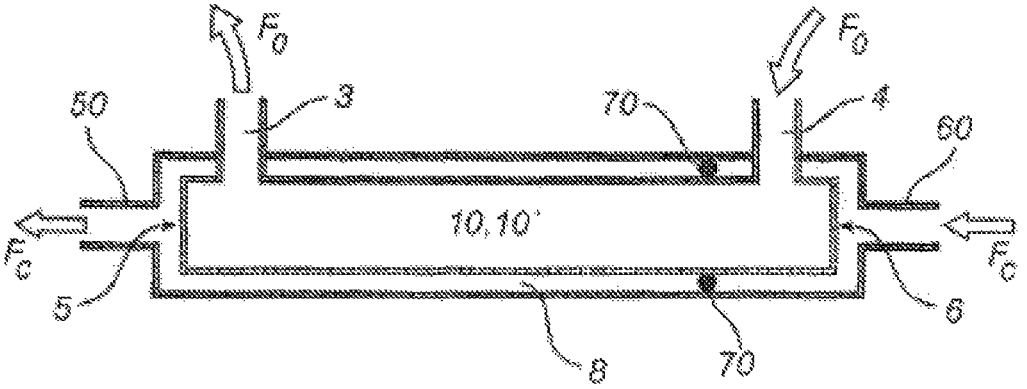
FIG. 6 is a schematic sectional view of an alternative embodiment of an oil cooling system.

Referring to FIG. 6, there is disclosed a heat exchanger system, which is similar to the one illustrated in FIG. 5, but where flow restrictors 70 are positioned around the heat exchanger 10, 10', thus entirely preventing any coolant from flowing around the heat exchanger. Such flow restrictors 70 may be combined with bypass restrictors 11, 11' extending at least from a position downstream the flow restrictors 70. The flow restrictors 70 may be provided in the form of sealing strips or sealant arranged to seal off the space between the heat exchanger 10, 10' and the cavity wall.

Figure 7:
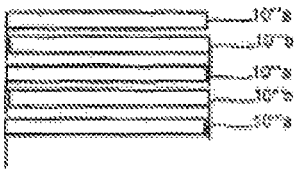
FIG. 7 is a schematic sectional view of a portion of a heat exchanger according to another architecture.

FIG. 7 shows a heat exchanger formed by a plurality of heat exchanger members 10'"*a*, 10'"*b*, each of which is formed as a substantially tubular member have a flange extending along its length direction. Each member may be formed by rolling or folding a piece of sheet metal or by extrusion. In either case, the forming of the tubular member may be followed by a flattening step and/or by insertion of an additional flange structure to increase heat transfer.

The heat exchanger may be formed as illustrated by a plurality of identical heat exchanger members, which are arranged such that their respective flange form all or a part of an outer wall. The heat exchangers members are arranged such that every the flange of every second heat exchanger member form part of the right outer wall and the flanges of the remaining heat exchanger members form a respective part of the left outer wall.

The length of the flange may vary according to various embodiments. In the illustrated embodiment, each flange has a length corresponding to the distance to the second to next heat exchanger member. However, longer flanges are conceivable, for example a length corresponding to the n to next heat exchanger member, where n is an even number.

In yet another alternative, the heat exchanger members forming the outermost heat exchanger members may have a respective flange, each of which forming a respective outer wall, while the remaining heat exchanger members have no flange at all, but are enclosed by the flanges of the two outermost heat exchanger members.

The invention claimed is:

1. A heat exchanger for cooling oil when immersed in a housing filled with a second fluid, comprising:

at least two elongate heat exchanger members, each of which enclosing a respective first channel between spaced apart plates, each plate having an interior surface facing the first channel and an opposing exterior surface, the at least two elongate heat exchanger members having an inlet end region with a common oil inlet, an axially spaced apart outlet end region with common oil outlet, and an elongate central region between the inlet and outlet end regions wherein;

a generally planar portion of the exterior surface of a first one of the heat exchanger members is facing a generally planar portion of the exterior surface of a second adjacent heat exchanger member, wherein an axially elongated second channel is formed between adjacent heat exchanger members for receiving the second fluid;

a plurality of elongated bypass restrictors each integrally formed by an elongate edge portion of one of spaced apart plates of the heat exchanger members, extending towards an edge portion of an adjacent heat exchanger member to further define the axially elongated second channel extending along the elongate central region in an enclosed manor with the second channel opening into the housing in the inlet and outlet end regions of the elongate heat exchanger members beyond the elongated bypass restrictors, and the bypass restrictors forming a pair of outer walls of the heat exchanger, extending substantially in parallel with a main flow direction in the enclosed central region of the elongate second channel.

2. The heat exchanger as claimed in claim 1, wherein the bypass restrictors extends continuously along said at least a part of said edge portion of said first one of the heat exchanger members.

3. The heat exchanger as claimed in claim 2, wherein the bypass restrictors extend substantially in parallel with a main flow direction in the second channel.

4. The heat exchanger as claimed in claim 3, wherein the bypass restrictors extend along at least ⅔ of a length of the second channel.

5. The heat exchanger as claimed in claim 2, wherein the bypass restrictors, along their extension, provide a substantially continuous seal between adjacent heat exchanger members.

6. The heat exchanger as claimed in claim 1, wherein the bypass restrictors are in contact with the edge portions of the adjacent heat exchanger members.

7. The heat exchanger as claimed in claim 1, wherein the bypass restrictors are joined with the edge portions of the adjacent heat exchanger members.

8. The heat exchanger as claimed in claim 1, wherein the bypass restrictors are provided by a folded edge portion of the heat exchanger member plate.

9. The heat exchanger as claimed in claim 8, wherein the bypass restrictors are formed by folding one or both of the heat exchanger plates forming the heat exchanger member.

10. The heat exchanger as claimed in claim 1, wherein the bypass restrictors are formed by a ridge in the immediate vicinity of the edge of one or both of the heat exchanger members.

11. The heat exchanger as claimed in claim 1, wherein at least one of the heat exchanger members is formed by a pair of joined together heat exchanger plates.

12. The heat exchanger as claimed in claim 1, wherein at least one of the heat exchanger members is formed by a substantially tubular body.

13. The heat exchanger as claimed in claim 1, wherein at least one of an inlet and an outlet of the second channel is open to a cavity in which the heat exchanger is to be placed.

14. The heat exchanger as claimed in claim 1, wherein edges of the plates are folded in different directions, with one of the edges extending beyond the other one and all the way to the adjacent heat exchanger member, thus forming one of the plurality of bypass restrictors.

* * * * *